US005353766A

United States Patent [19]

Peters et al.

[11] Patent Number: 5,353,766

[45] Date of Patent: Oct. 11, 1994

[54] DISTRIBUTOR FOR A HIGH PRESSURE FUEL SYSTEM

[75] Inventors: Lester L. Peters; Bai M. Yen; Julius P. Perr, all of Columbus, Ind.

[73] Assignee: Cummins Engine Company, Inc., Columbus, Ind.

[21] Appl. No.: 117,697

[22] Filed: Sep. 8, 1993

[51] Int. Cl.[5] ..... F02M 41/00

[52] U.S. Cl. ..... 123/450; 417/206; 137/636.1

[58] Field of Search ..... 123/450, 458, 495, 500, 123/501, 449; 417/204, 206, 205, 362; 137/636.1, 636

[56] References Cited

U.S. PATENT DOCUMENTS

| | | | |
|---|---|---|---|
| 2,105,100 | 1/1938 | Starr . | |
| 2,146,184 | 2/1939 | High | 417/206 |
| 2,391,174 | 12/1945 | Lownsbery . | |
| 2,412,316 | 12/1946 | Campbell | 417/206 |
| 2,608,158 | 8/1952 | Beaman | 417/206 |
| 2,697,401 | 12/1954 | Barberena | 123/450 |
| 2,867,198 | 1/1959 | Peras | 123/450 |
| 2,910,056 | 10/1959 | Sampietro | 123/450 |
| 2,914,053 | 11/1959 | Hittell | 123/450 |
| 3,044,495 | 7/1962 | Alfieri | 137/636.1 |
| 3,598,507 | 8/1971 | Voit et al. . | |
| 3,718,496 | 11/1975 | Byers | 137/636.1 |
| 3,777,776 | 12/1973 | Boisserand . | |
| 3,783,898 | 1/1974 | Kirkman | 137/636.1 |
| 3,927,652 | 12/1975 | O'Neill | 123/450 |
| 4,132,201 | 1/1979 | Bart | 123/451 |
| 4,233,002 | 11/1980 | Birenbaum . | |
| 4,502,445 | 3/1985 | Roca-Nierga et al. . | |
| 4,531,494 | 7/1985 | Bailey | 123/450 |
| 4,541,394 | 9/1985 | Schechter | 123/451 |
| 4,566,492 | 1/1986 | Bessard | 137/636.1 |
| 4,586,480 | 5/1986 | Kobayashi et al. . | |
| 4,788,960 | 12/1988 | Oshizawa . | |
| 4,792,285 | 10/1982 | Chapman | 123/450 |
| 4,838,233 | 6/1989 | Hayashi | 123/506 |
| 4,905,960 | 3/1990 | Barnhart et al. . | |
| 5,094,216 | 3/1992 | Miyaki | 123/506 |
| 5,213,084 | 5/1993 | Linder et al. . | |

FOREIGN PATENT DOCUMENTS 611423 10/1948 United Kingdom .

*Primary Examiner*—Carl S. Miller

*Attorney, Agent, or Firm*—Sixbey, Friedman, Leedom & Ferguson

[57] ABSTRACT

A fuel distributor is provided which is capable of distributing fuel through plural fuel injection lines to the corresponding cylinders of a multicylinder internal combustion engine and which includes a distributor housing including a supply inlet passage, a plurality of fuel injection outlet passages and a plurality of distributor valves for providing sequential periodic fluidic communication between the supply inlet passage and the outlet passages. Each distributor valve, which may be cam-actuated or solenoid-actuated, is adapted to be placed in an open position to define a fuel injection period during which high pressure fuel may flow through the distributor valve to the respective engine cylinder and a closed position blocking fuel flow through the respective fuel injection outlet passage. Each of the distributor valves is adapted to receive a force from the high pressure fuel flowing from the supply inlet passage which urges the distributor valve into the closed position thereby providing an effective seal and minimizing leakage. The distributor may be used in a high pressure fuel system having a control valve positioned between a high pressure accumulator and the fuel distributor for controlling the flow of high pressure fuel to the distributor. The control valve is moveable to define a fuel injection event, occurring within the injection period provided by each distributor valve, during which high pressure fuel may flow from the high pressure supply means through one of the distributor valves to a respective engine cylinder.

17 Claims, 4 Drawing Sheets

DISTRIBUTOR FOR A HIGH PRESSURE FUEL SYSTEM

TECHNICAL FIELD

This invention relates to an improved fuel distributor for a high pressure fuel system which effectively enables the delivery of precise quantities of fuel to a plurality of engine cylinders.

BACKGROUND OF THE INVENTION

Many fuel injection systems for internal combustion engines use a fuel distributor for delivering fuel to fuel injectors associated with respective engine cylinders. The distributor functions to fluidically connect a supply fuel passage to each fuel injector or engine cylinder one at a time through separate fuel injection lines extending from the distributor to each injector. For example, U.S. Pat. No. 4,586,480 to Kobayashi et al. discloses a well known and commonly used distributor comprised of a rotating shaft having a radial supply passage which sequentially aligns with fuel delivery passages corresponding to each engine cylinder. Each period of time defined by the alignment of the supply passage with a delivery passage creates a window of opportunity for injection during which a solenoid valve functions to control the actual amount of fuel delivered to the injector. The rotating shaft also reciprocates to pump the supply fuel through the delivery passages.

A similar type of distributor is disclosed in U.S. Pat. No. 3,598,507 to Voit wherein a rotating shaft contains radially extending supply passages for sequential alignment with delivery passages formed in the distributor housing to deliver fuel to the engine cylinders based on the position of two solenoid operated control valves. Unlike the distributor disclosed in Kobayashi, fuel is pumped through the aligned passages by pump pistons radially disposed in bores formed in the distributor shaft and positioned against a cam ring such that rotation of the shaft causes the pistons to reciprocate through pumping and suction strokes.

Although the distributors disclosed in Kobayashi and Voit both function adequately to deliver metered quantities of fuel to the engine cylinders at low to medium injection pressures, a small amount of leakage occurs between the radially extending passages during each delivery or injection event in the clearance formed between the rotary shaft and the shaft bore formed in the distributor housing within which the shaft rotates. Although this clearance is necessary to permit the distributor shaft to rotate and, in some designs, reciprocate, high pressure injection fuel leaking through this clearance into the adjacent low pressure delivery passages, or other areas of the distributor, makes accurate control of injection metering difficult and/or contributes to excessive parasitic pumping losses. The leakage not only upsets the predictability of the injection characteristics of the delivery passages in alignment but also the injection characteristics of the adjacent delivery passages by pressurizing the passages to an unknown pressure before the respective injection period. Also, the distance between the adjacent delivery passages around the circumference of the shaft is very small due to the compact nature of the distributor and shaft, thereby undesirably creating very short sealing lengths thus increasing leakage.

Moreover, the aforementioned problems, and other complications, caused by the necessary clearances between the distributor shaft and bore, and the associated short sealing lengths, in the conventional rotary distributor are only exacerbated by higher injection pressures required by modem fuel systems. Recent and upcoming legislation resulting from a concern to improve fuel economy and reduce emissions continues to place strict emissions standards on engine manufacturers. In order for new engines to meet these standards, it is necessary to produce fuel injection systems capable of achieving higher injection pressures while maintaining accurate and reliable control of the metering and timing functions. One such high pressure fuel injection system is disclosed in U.S. patent application Ser. No. 057,489 entitled Compact High Pressure Fuel System with Accumulator, commonly assigned to the assignee of the present application wherein an accumulator temporarily stores fuel supplied by a high pressure variable displacement pump for delivery to a distributor via a solenoid controlled three-way valve. This system is capable of achieving extremely high injection pressures in excess of 20,000 psi. However, as with the distributor disclosed in Kobayashi and Voit, the distributor is a conventional rotary distributor using the sequential alignment of a supply passage with a plurality of injection passages to allow delivery of fuel to the injectors of corresponding cylinders. As discussed hereinabove, these distributors rely on a clearance fit between the rotary shaft and the bore, and very short sealing lengths, to isolate the high pressure injection occurring in one delivery passage from the remaining passages. At high injection pressures, fuel leakage through the clearance between the shaft and bore becomes unacceptable. Moreover, it has been found that rotary shafts exposed to high injection pressures are prone to seizures during operation especially when using low viscosity and aromatic fuels.

U.S. Pat. No. 2, 105,100 to Starr discloses a fuel injection system including a distributor having poppet-type distributor valves which are sequentially opened and closed by respective cams to deliver premetered fuel to respective fuel delivery lines leading to respective injectors. These poppet-type valves at least partially overcome the above-noted shortcomings associated with a rotary distributor by providing a valve element which abuts a valve seat to create a positive seal having a longer seal length without the need for leakage causing clearances. However, these poppet-type valves are arranged such that pressurized fuel for injection acts on each valve element in an opening direction against the force of a biasing spring which acts on the valve element in the closing direction. As a result, although the fuel pressure may advantageously assist in the opening of the valve associated with the engine cylinder ready for injection, the fuel pressure also undesirably tends to open the remaining valves which must remain in the sealingly closed position to ensure accurate and predictable control of injection. Consequently, the likelihood of leakage through the poppet-type valve is increased. Although the valve element may be designed to be force balanced to some degree in the closed position in an effort to minimize the opening force caused by the fuel pressure, this requires additional design and manufacturing costs. Moreover, as injection pressures increase, any tendency of the valve to open due to fuel pressure acting on the valve element also increases thus increasing the likelihood of leakage through the valve seat. Also, the biasing spring must be stronger, and possibly larger, than necessary to overcome the tendency of the valve to open. The distributor disclosed in Starr also fails to disclose a means for varying the timing of injection and therefore, could not effectively control injection throughout a wide range of operating conditions to meet the recent and upcoming emissions standards. The opening and closing of the poppet-type distributor valves disclosed in Starr defines the beginning and end of injection, respectively. As a result, the biasing spring must also be of sufficient strength to force the valve element into the closed position at the end of injection against the force of the pressurized fuel.

Consequently, there is a need for a fuel distributor for distributing high pressure fuel through a plurality of distributor valves to the cylinders of an engine which effectively controls the flow of fuel through each of the distributor valves.

SUMMARY OF THE INVENTION

It is an object of the invention, therefore, to overcome the disadvantages of the prior art and to provide a distributor for a high pressure fuel system capable of accurately and effectively enabling the sequential distribution of fuel to the cylinders of an engine.

It is another object of the present invention to provide a distributor using distributor valves arranged so as to be urged toward a closed position by high pressure injection fuel flowing to the distributor, thereby insuring an effective seal and minimizing leakage through the valve seat.

It is yet another object of the present invention to provide a distributor using poppet-type valves having a valve element for engaging a valve seat to provide a positive seal with a long seal length to minimize leakage through the valve when in a closed position.

It is a further object of the present invention to provide a distributor for a high pressure fuel system which minimizes the likelihood of the distributor shaft seizing during operation.

It is a still further object of the present invention to provide a high pressure fuel system capable of accurately and effectively controlling the timing and metering of injection while minimizing leakage through the distributor valves.

Still another object of the present invention is to provide a high pressure fuel system including a distributor using poppet-type valves which do not open or close against the high pressure injection fuel thus minimizing the force necessary to operate the distributor valves and the stress developed between the valve and its actuating mechanism.

These and other objects are achieved by providing a fuel distributor for a high pressure fuel injection system capable of distributing fuel at a predetermined pressure through plural fuel injection fines to the corresponding cylinders of a multi-cylinder internal combustion engine comprising a distributor housing including a supply inlet passage and a plurality of fuel injection outlet passages for delivering high pressure fuel from the supply inlet passage to the plural injection fines. A plurality of distributor valves, each positioned in fluid communication with a respective outlet passage, function to provide sequential periodic fluidic communication between the supply inlet passage and the respective injection outlet passages. Each distributor valve is adapted to be placed in an open position to define a fuel injection period during which high pressure fuel may flow through the distributor valve to the respective engine cylinder and a closed position blocking fuel flow through the respective fuel injection outlet passage. Each of the distributor valves is adapted to receive a force from the high pressure fuel flowing from the supply inlet passage which urges the distributor valve into the closed position thereby providing an effective seal and minimizing leakage. The distributor valves may be of the poppet-type having a valve element mounted for reciprocal movement in a valve cavity formed in the distributor housing. When in the closed position, each distributor valve engages a respective valve seat formed in the distributor housing. A bias spring may be used to bias each distributor valve into engagement with the valve seat. Delivery valves may be provided in the fuel injection outlet passages for preventing the flow of fuel from the injection fines back through the distributor valves.

In one embodiment of the present invention, each distributor valve is operated by a cam formed on an end face of a camshaft mounted for rotational movement in the distributor housing wherein the end face is positioned perpendicular to the rotational axis of the camshaft and the valve elements reciprocate along a longitudinal axis parallel to the rotational axis of the camshaft. In another embodiment, the camshaft includes an inner annular surface extending around the rotational axis of the camshaft so that the valve elements are positioned between the inner annular surface and the camshaft while being reciprocable along a longitudinal axis perpendicular to the rotational axis of the camshaft. In yet another embodiment the camshaft may include an outer annular surface extending around the rotational axis of the camshaft so that the valve elements reciprocate along a longitudinal axis perpendicular to the rotational axis of the camshaft.

The present invention also provides a high pressure fuel injection system for distributing fuel at a predetermined pressure through the injection fines which includes a high pressure fuel supply means for supplying fuel through a fuel transfer circuit to the respective engine cylinders. A fuel distributor positioned along the fuel transfer circuit for enabling sequential periodic fluidic communication between the high pressure fuel supply and the engine cylinders includes a plurality of distributor valves adapted to be placed in an open position to define a fuel injection period during which high pressure fuel may flow through the distributor valve to the respective engine cylinder and a closed position blocking fuel flow through the respective fuel injection line. Each distributor line is adapted to receive a force from the high pressure fuel flowing from the high pressure supply means which urges the valve into the closed position. A control valve positioned along the fuel transfer circuit between the high pressure supply means and the fuel distributor controls the flow of fuel to the distributor. The control valve is moveable between a first position wherein fuel may flow therethrough to the distributor during the injection period and a second position wherein fuel flowing therethrough to the distributor is blocked. The control valve is moveable from the second position to the first position and from the first position to the second position within the injection period to define a fuel injection event during which high pressure fuel may flow from the high pressure supply means through one of the distributor valves to a respective engine cylinder. The high pressure fuel supply means may include a pump and an accumulator for accumulating and temporarily storing fuel at high pressure received from the pump. Also, the control valve may be a two-position three-way solenoid valve which allows fluidic communication between a drain line and a portion of the transfer passage located between the control valve and the distributor when the control valve is in the closed position.

DETAILED DESCRIPTION OF THE PREFERRED EMBODIMENT

Figure 2:
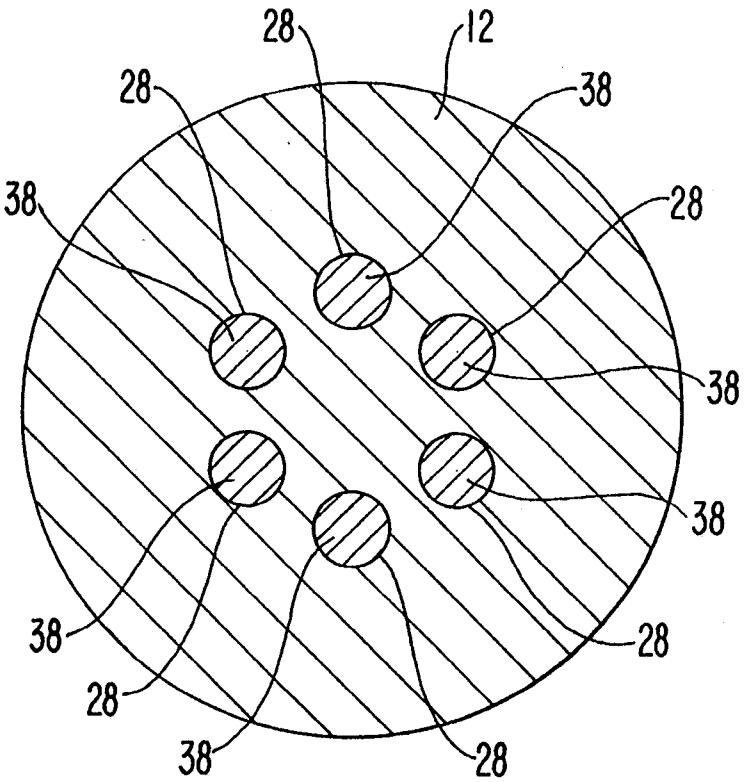
FIG. 2 is a cross sectional view of the fuel distributor of FIG. 1 taken along plane 2—2.
Figure 1:
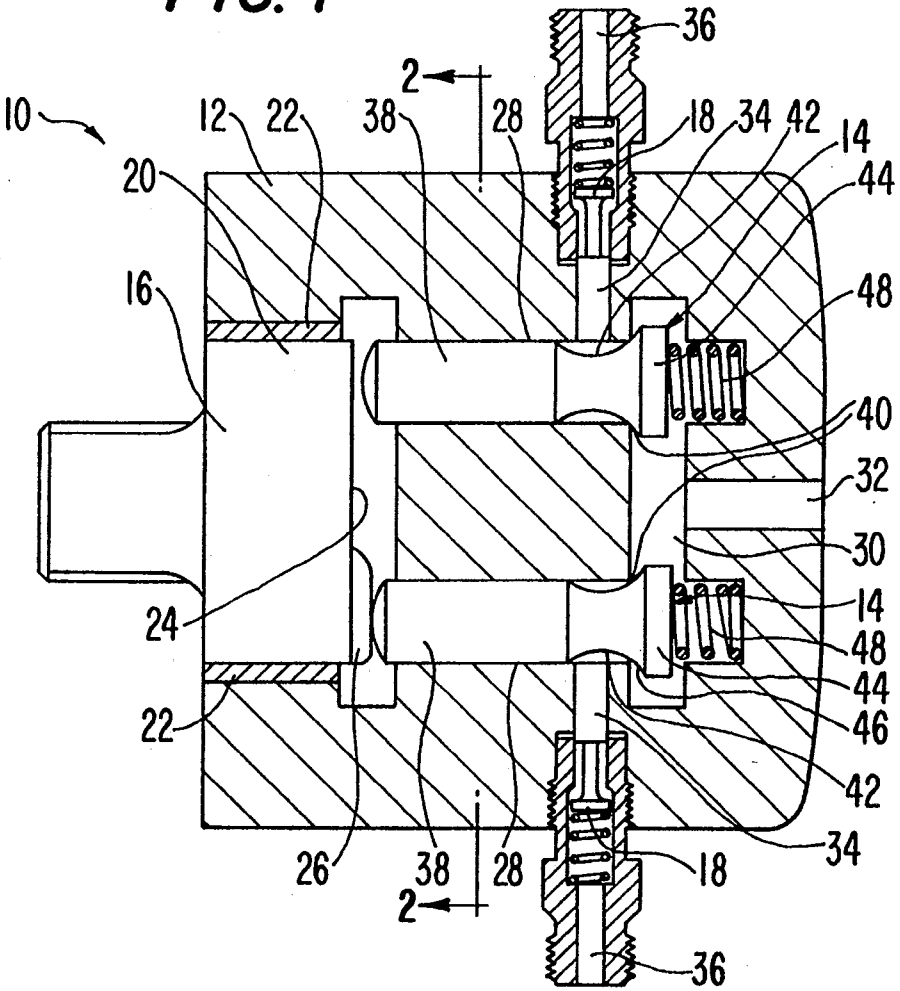
FIG. 1 is a cross sectional view of the fuel distributor of the present invention.

Referring to FIGS. 1 and 2, there is shown a fuel distributor 10 of the present invention as applied to a six-cylinder engine (not shown) having one distributor valve associated with each cylinder. Generally, the fuel distributor 10 includes a distributor housing 12 containing distributor valves 14 which are operated by a rotating camshaft 16 to deliver pressurized fuel through delivery valves 18 to the engine cylinders (not shown).

The distributor housing 12 includes a large cylindrical recess 20 formed in one end of housing 12 for receiving rotating camshaft 16. A seal 22 is provided between the outer annular surface of camshaft 16 and distributor housing 12 to prevent fuel from leaking between camshaft 16 and housing 12 while permitting camshaft 16 to rotate. Camshaft 16 includes an end face 24 having a cam 26 formed thereon for operating distributor valves 14 during rotation of the camshaft 16. Cam 26 is positioned on the outer radial portion of end face 24 for sequentially contacting distributor valves 14.

Distributor housing 12 further includes a plurality of valve cavities 28 extending axially along the rotational axis of camshaft 16 perpendicular to end face 24. Valve cavities 28 are equally spaced in a circular formation, as shown in FIG. 2, and extend from the inner end of cylindrical recess 20 to communicate with a supply chamber 30. A supply inlet passage 32 is formed in distributor housing 12 to direct high pressure supply fuel to supply chamber 30. A respective fuel injection outlet passage 34 extends radially outward from each valve cavity 28 through housing 12 for delivering high pressure fuel to respective fuel injection lines 36 leading to the engine cylinders. A delivery valve 18 is positioned in each outlet passage 34 to prevent the flow of fuel from each fuel injection line 36 back through distributor 10.

Distributor valves 14 are each preferably of the poppet-type including both a valve element 38 positioned for reciprocal movement in valve cavity 28 and a valve seat 40 formed in distributor housing 12. Each valve element 38 extends, at one end, into the inner end of cylindrical recess 20 adjacent end face 24 of camshaft 16 so as to be positioned for engagement by cam 26 during rotation of camshaft 16. The opposite end of valve element 38 includes an annular recess 42 positioned adjacent a respective outlet passage 34, and an annular land 44 extending into supply chamber 30. Valve seat 40 is formed annularly around valve cavity 28 adjacent supply chamber 30. An annular seating surface 46 formed on valve element 38 between annular recess 42 and annular land 44 is adapted to engage valve seat 40 to block fluidic communication between supply chamber 30 and outlet passage 34 when distributor valve 14 is in the closed position. A valve spring 48 positioned in one end of valve cavity 28 adjacent annular land 44 biases valve element 38 toward camshaft 16 and, therefore, biases annular seating surface 46 toward valve seat 40.

Figure 3:
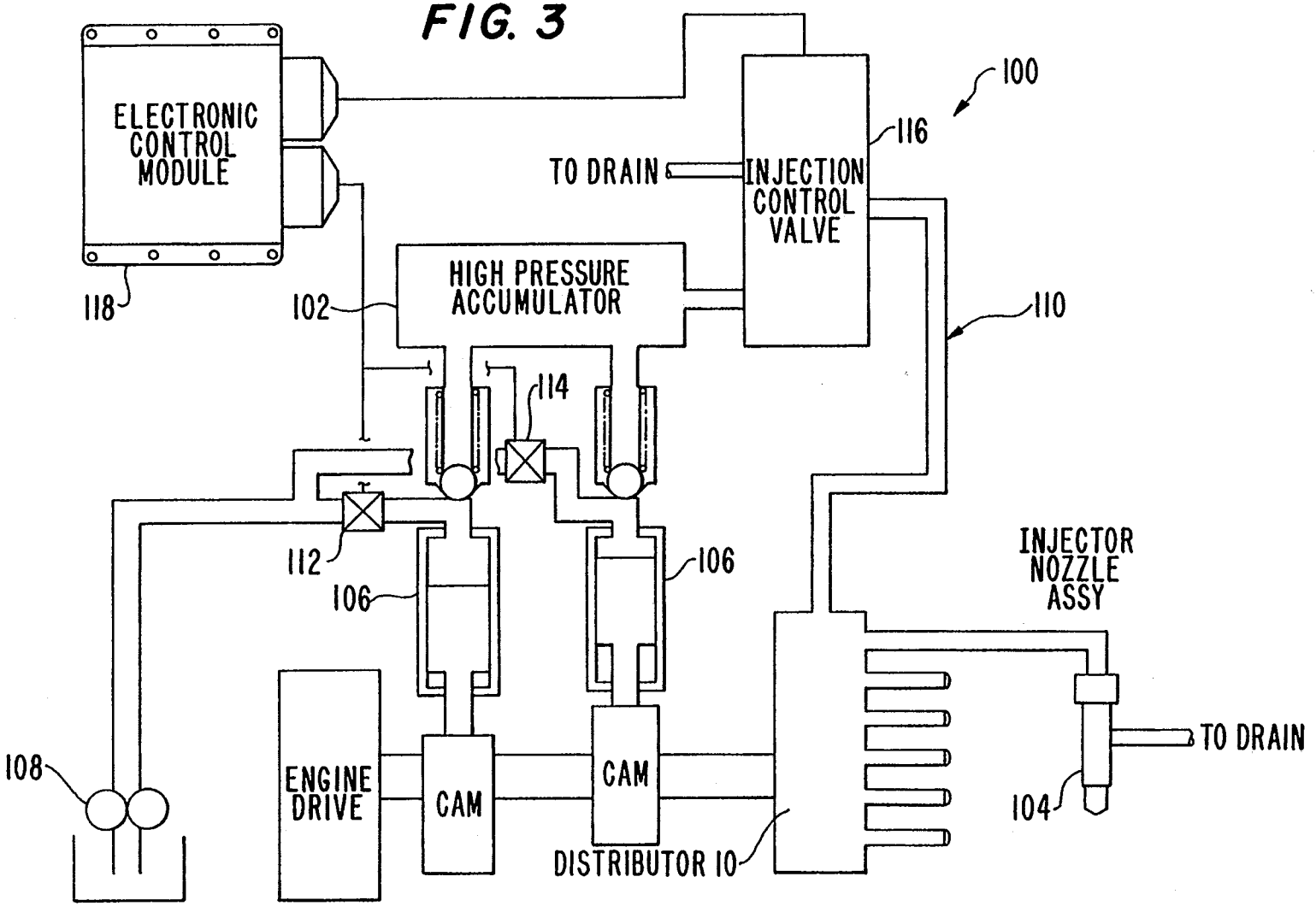
FIG. 3 is a schematic view of the high pressure fuel distribution system of the present invention incorporating the fuel distributor of FIG. 1.

Reference is now made to FIG. 3 disclosing a high pressure fuel system 100 incorporating the fuel distributor 10 of FIG. 1. A full description of the high pressure fuel system of FIG. 3, not including a description of the fuel distributor of the present invention, is set forth in commonly assigned U.S. patent application Ser. No. 057,489, entitled Compact High Pressure Fuel System with Accumulator, which is hereby incorporated by reference. Briefly, high pressure fuel system 100 includes a high pressure accumulator 102 for receiving high pressure fuel for delivery to fuel injectors 104 of an associated engine, a high pressure pump 106 for receiving low pressure fuel from a low pressure supply pump 108 and delivering high pressure fuel to accumulator 102 and the fuel distributor 10 for providing periodic fluidic communication between accumulator 102 and each injector 104 associated with a respective engine cylinder (now shown). The system also includes a fuel transfer circuit 110 extending from low pressure supply pump 108 to each of the injectors 104, and at least one pump control valve 112, 114 positioned along fuel transfer circuit 110 to pump 106 for controlling the amount of fuel delivered to accumulator 102 so as to maintain a desired fuel pressure in accumulator 102. Also, one or more injection control valves 116 positioned along fuel transfer circuit 110 from accumulator 102 to distributor 10 is provided for controlling the timing and quantity of fuel injected into each engine cylinder in response to engine operating conditions. An electronic control module or unit (ECU) 118 controls the operation of pump control valves 112, 114 and injection control valve 116 based on various engine operating conditions to accurately control the amount of fuel delivered by distributor 10 to each injector 104 thereby effectively controlling fuel timing and metering. The injection control valve may be of the solenoid-controlled two-position three-way type disclosed in U.S. patent application Ser. No. 034,841, entitled Force Balanced Three-Way Solenoid Valve, which is hereby incorporated by reference.

Figure 4:
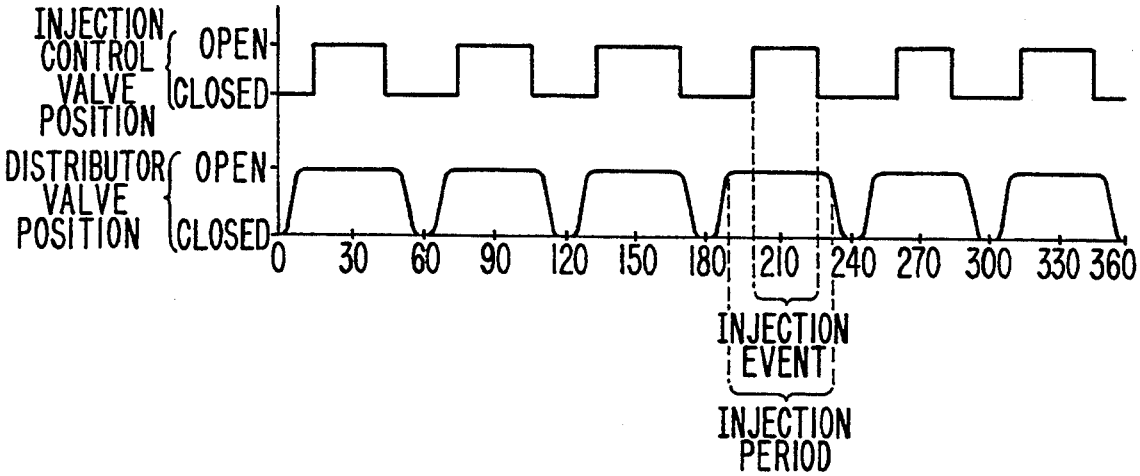
FIG. 4 is a graph showing the injection period for each of six distributor valves of the distributor shown in FIG. 1 corresponding to a respective engine cylinder and the respective injection event defined by the solenoid control valve shown in FIG. 3.

Operation of the fuel distributor of FIG. 1 will now be discussed in accordance with its use in the high pressure fuel system of FIG. 3. Camshaft 16 rotates at half the speed of the crank shaft (not shown) of the engine so that during a complete cycle of the engine, i.e., two complete rotations of the crank shaft, the camshaft will rotate 360° causing cam 26 to operate each distributor valve 14 to provide one period of fluidic communication between supply inlet passage 32 and outlet passage 34 for each distributor valve 14. As camshaft 16 rotates, cam 26 sequentially engages valve element 38 of each distributor valve 14 moving valve element 38 to the right as shown in FIG. 1 against the bias pressure of valve spring 48. In this manner, annular seating surface 46 moves away from valve seat 40 placing distributor valve 14 in an open position fluidically connecting supply inlet passage 32 with the respective outlet passage 34. As camshaft 16 continues to rotate, cam 26 passes by the end of the open valve element 38 allowing valve element 38 to return to a closed position against valve seat 40 under the force of valve spring 48. The opening and closing of each distributor valve 14 defines an injection period as shown in FIG. 4 for each distributor valve. The operation of each of the six distributor valves shown in FIG. 2 are represented graphically in FIG. 4 throughout one complete rotation of camshaft 16. As can be seen from FIG. 4, at any given time during the rotation of camshaft 16, only one distributor valve 14 is in an open position defining an injection period or window of opportunity for an injection event as determined by the operation of control valve 116. As can be seen from FIG. 4, injection control valve 116 only opens to supply high pressure fuel to inlet passage 32 and supply chamber 30 of distributor 10 during the injection period of a respective distributor valve 14. Moreover, when the three-way control valve 116 is in the position blocking fluidic communication between the high pressure supply fuel and distributor 10, the control valve connects the inlet passage 32 and supply chamber 30 to drain as shown in FIG. 3. As a result, each distributor valve 14 is moved by cam 26 between open and closed positions against low pressure fuel in supply chamber 30 and, therefore, not high pressure fuel. Consequently, the stresses in camshaft 16 and valve elements 38 caused by the pressure induced forces of the fuel in supply chamber 30 are minimized.

Control valve 116 opens and subsequently closes during each injection period to define an injection event during which high pressure fuel from accumulator 102 is delivered through fuel transfer circuit 110 and a respective distributor valve 14 to a corresponding injection line 36 for delivery to the respective injector 104 and associated engine cylinder (not shown). During each injection event, high pressure fuel entering supply chamber 30 flows through the open distributor valve 14 into outlet passage 34 and through delivery valve 18. Most importantly, the high pressure fuel in supply chamber 30 also acts against the outer end of each valve element 38 of the remaining five distributor valves 14 which are in the closed position. Thus, the high pressure of the fuel in supply chamber 30 tends to urge valve element 38 to the left in FIG. 1 towards the closed position. As a result, at any given time during the cycle of the engine, the annular seating surface 46 of each of the five closed distributor valves 14 will be urged into tight sealing engagement with a respective valve seat 40. In this manner, the present invention prevents leakage of high pressure fuel from a supply into fuel injection fines not timely designated for receiving injection fuel.

Figure 5:
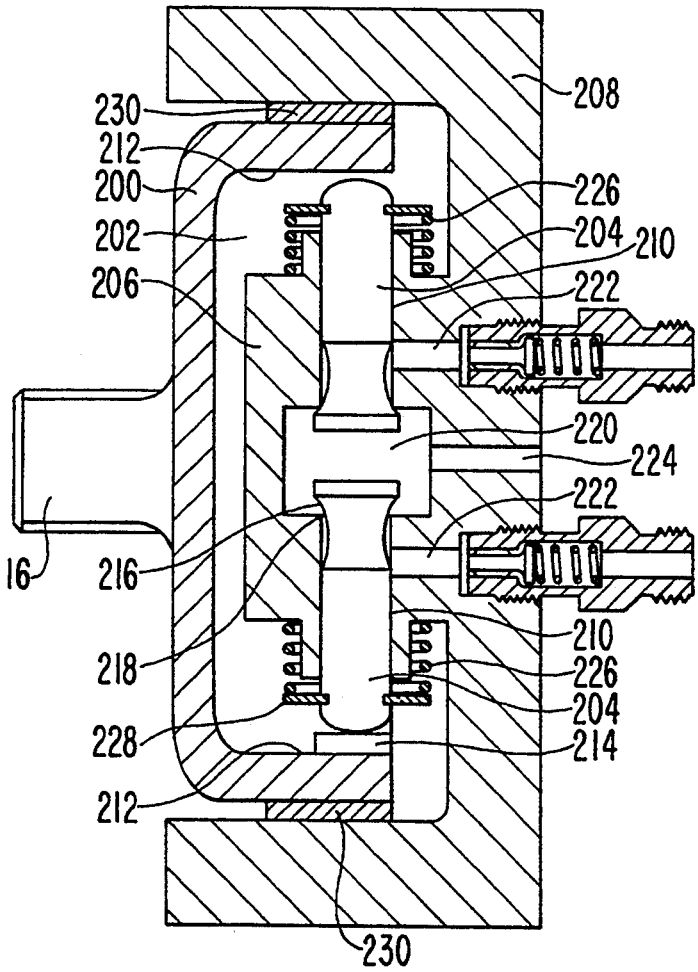
FIG. 5 is a cross sectional view of a second embodiment of the distributor of the present invention.

FIG. 5 illustrates another embodiment of the fuel distributor of the present invention wherein camshaft 16 includes a cylindrically shaped end piece 200 which forms a recess 202. A center portion 206 of distributor housing 208 extends inwardly into recess 202 and includes valve cavities 210 for receiving respective valve elements 204. End piece 200 includes an inner annular surface 212 on which a cam 214 is formed for engaging one end of each valve element 204 as camshaft 16 rotates. In this embodiment, valve elements 204 extend radially outwardly so that each valve element 204 reciprocates under the force of cam 214 in a longitudinal axis perpendicular to the rotational axis of camshaft 16. As with the embodiment shown in FIG. 1, each valve element 204 includes an annular seating surface 216 for engaging a valve seat 218 formed on the distributor housing to block fluidic communication between a supply chamber 220 and an injection outlet passage 222 corresponding to each engine cylinder. A supply passage 224 formed in distributor housing 208 supplies high pressure fuel to supply chamber 220. In this embodiment, valve spring 226 is positioned at the end of each valve element 204 opposite annular seating surface 216. The valve spring 226 engages the distributor housing 208 at one end while a snap ring 228 attached to the valve element 204 provides a seating surface for the other end of bias spring 226. An appropriate seal 230 may be provided between the outer annular surface of end piece 200 and distributor housing 208 to prevent leakage of fuel out of recess 202.

Figure 6:
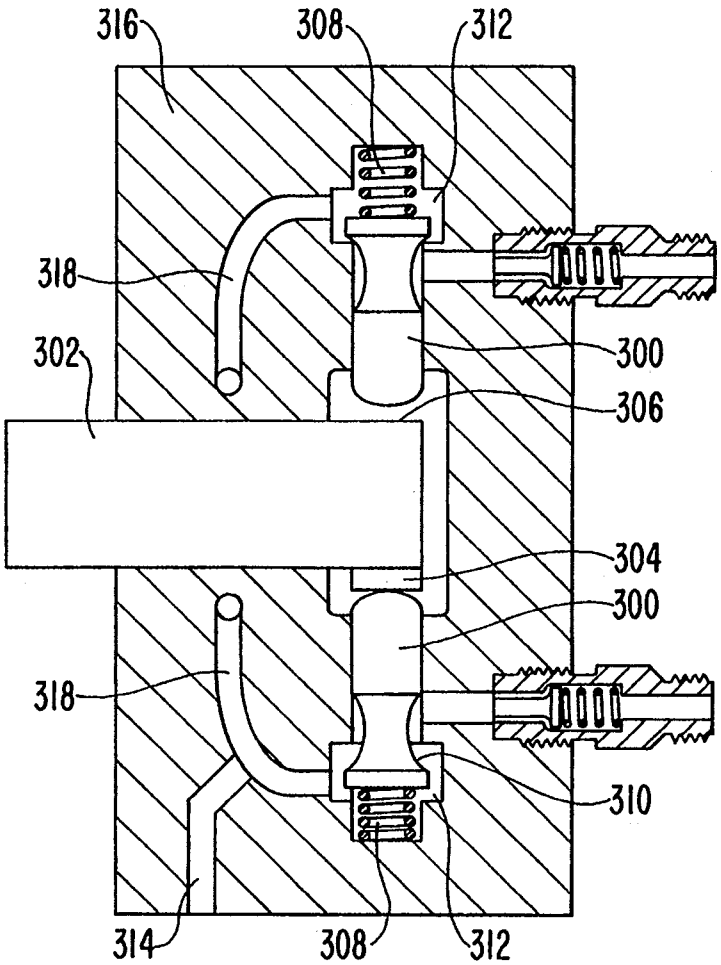
FIG. 6 is a third embodiment of the distributor of the present invention.

FIG. 6 represents another embodiment of the distributor of the present invention which is similar to the embodiment of FIG. 5 in that each valve element 300 extends radially outwardly from the rotational axis of camshaft 302. However, in this embodiment, valve elements 300 are reciprocated by a cam 304 formed on an outer annular surface 306 of camshaft 302. Each valve element 300 is biased inwardly toward the rotational axis of camshaft 302 into the closed position by a bias spring 308 which engages the outward end of the respective valve element 300 adjacent annular seating surface 310. A supply chamber 312 is formed adjacent the outward end of each valve element 300. High pressure fuel is delivered to supply chambers 312 via a supply passage 314 formed in distributor housing 316 and corresponding fuel transfer passages 318 extending from supply passage 314 to each supply chamber 312. As with the distributor housings of the previous embodiments, distributor housing 316 may be formed in two or more sections for ease of manufacture, i.e., to facilitate the formation of various passages, and to aid in assembly.

Figure 7:
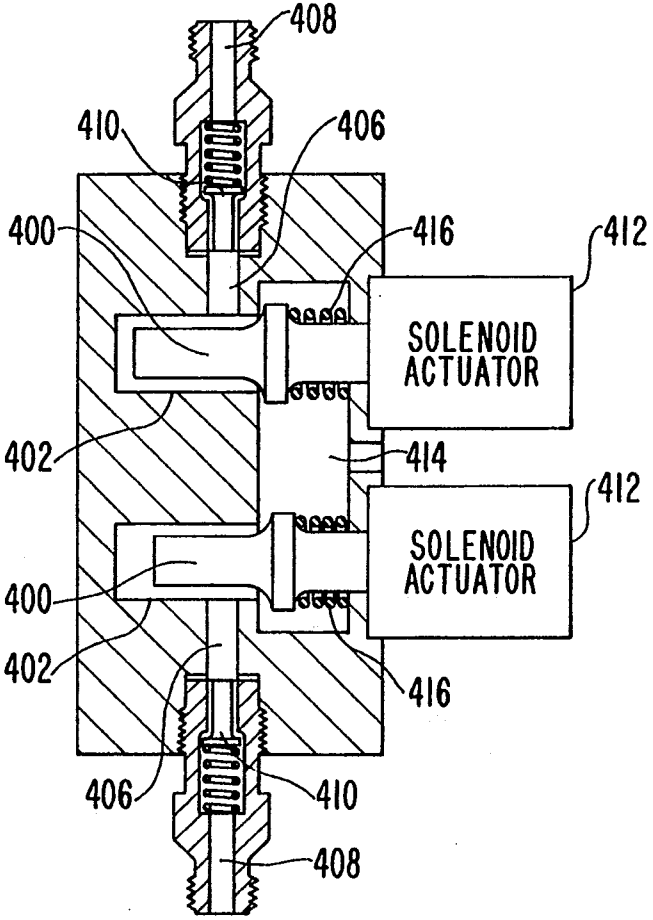
FIG. 7 is a fourth embodiment of the distributor of the present invention wherein each distributor valve is operated by a solenoid actuator.

FIG. 7 represents yet another embodiment of the distributor of the present invention which includes a circular array of valve elements 400 positioned in corresponding valve cavities 402 extending longitudinally through a distributor housing 404. As with the previous embodiments, respective injection outlet passages 406 extend from each valve cavity 402 to communicate with a respective fuel injection line 408 via a respective delivery valve 410. However, in this embodiment, each valve element 400 is moved between the open and closed positions by a solenoid actuator 412. Based upon engine conditions, each solenoid actuator 412 is energized by a signal from an ECU (not shown) which moves the valve element 400 into the open position allowing fluidic communication between a supply chamber 414 and the respective outlet passage 406. Once the injection control valve 116 shown in FIG. 3 operates to define an injection event, the respective solenoid actuator 412 is de-energized allowing a valve spring 416 to force the valve element 400 into the closed position blocking fluidic communication between supply chamber 414 and the respective outlet passage 406. The solenoid actuator and valve assembly of this embodiment may be of the form disclosed in U.S. Pat. No.

4,905,960, commonly owned by the assignee of the present invention, which is hereby incorporated by reference.

Each of the above-described embodiments of the present invention provides a fuel distributor for a high pressure fuel system which minimizes the leakage from the supply circuit through closed distributor valves corresponding to engine cylinders not timely prepared for injection by providing distributor valves arranged so as to be urged against a valve seat by the supply fuel pressure into a closed, tightly sealed position. Moreover, the present invention provides a high pressure fuel system which accurately and reliably controls timing and metering of injection while minimizing the stresses on the distributor valve and its actuating mechanism, e.g. a camshaft or a solenoid assembly, by only operating the distributor valves in the presence of low pressure fuel.

Industrial Applicability

While the fuel distributor and the high pressure fuel system of the present invention are most useful in fuel systems requiring distribution of fuel under high pressures, the distributor and system can be used in any combustion engine of any vehicle or industrial equipment in which accurate and reliable fuel distribution is essential. The high pressure fuel system of the present invention is especially appropriate for applications in which accurate control and variation of timing of injection and metering of the proper quantity of fuel is essential.

We claim:

1. A high pressure fuel injection system for distributing fuel at a predetermined pressure through plural fuel injection lines to the corresponding cylinders of a multi-cylinder internal combustion engine, comprising:

a high pressure fuel supply means for supplying fuel at high pressure for delivery to the cylinders of the engine;

a fuel transfer circuit communicating said high pressure fuel supply means with the engine cylinders and including a plurality of fuel injection lines each associated with a respective engine cylinder;

a fuel distributor means positioned along said fuel transfer circuit for enabling sequential periodic fluidic communication between said high pressure fuel supply means and the engine cylinders through said plurality of fuel injection fines, said fuel distributor means including a plurality of distributor valves, each of said plurality of distributor valves being positioned in fluidic communication with a respective one of said plurality of fuel injection lines and adapted to be placed in an open position to define a fuel injection period during which high pressure fuel may flow through said distributor valve to the respective engine cylinder and a closed position blocking fuel flow through said respective fuel injection fine, wherein each of said plurality of distributor valves is adapted to receive a force from the high pressure fuel flowing from said high pressure supply means which urges said distributor valve into the closed position;

a control valve means positioned along said fuel transfer circuit between said high pressure fuel supply means and said fuel distributor means for controlling the flow of fuel to said distributor means, wherein said control valve means is movable between a first position wherein fuel may flow therethrough to said distributor means during said injection period and a second position wherein fuel flowing therethrough to said distributor means is blocked, said control valve means being movable from said second position to said first position and from said first position to said second position within said injection period to define a fuel injection event during which high pressure fuel may flow from said high pressure supply means through one of said plurality of distributor valves to a respective engine cylinder.

2. The fuel injection system of claim 1, wherein said high pressure fuel supply means includes a pump means for pressurizing fuel above the predetermined pressure and an accumulator means for accumulating and temporarily storing fuel at high pressure received from said pump means, said control valve means including a two-position three-way solenoid valve movable between said open and said closed positions, wherein a portion of said fuel transfer passage located between said solenoid valve and said distributor means fluidically communicates with a drain line when said solenoid valve is in said closed position.

3. The high pressure fuel injection system of claim 1, wherein said distributor housing includes a plurality valve seats, each one said valve seats positioned adjacent a respective one of said distributor valves, each of said distributor valves being of the poppet-type having a valve element mounted for reciprocal movement in said distributor housing for engaging a respective one of said valve seats when said poppet-type distributor valve is in the closed position.

4. The high pressure fuel injection system of claim 3, wherein said poppet-type distributor valves are moved from the closed to the open position by a solenoid actuator.

5. The high pressure fuel injection system of claim 3, further including a camshaft rotationally mounted in said distributor housing, said camshaft including a cam for causing said valve elements of said poppet-type distributor valves to reciprocate as said camshaft is rotated.

6. The high pressure fuel injection system of claim 5, wherein said camshaft includes an end face positioned perpendicular to a rotational axis of said camshaft, said cam formed on said end face and said valve elements reciprocable along a longitudinal axis parallel to the rotational axis of said camshaft.

7. The high pressure fuel injection system of claim 5, wherein said camshaft includes an inner annular surface extending annularly around a rotational axis of said camshaft, said cam formed on said inner annular surface and said valve elements reciprocable along a longitudinal axis perpendicular to the rotational axis of said camshaft.

8. The high pressure fuel injection system of claim 5, wherein said camshaft includes an outer annular surface extending around a rotational axis of said camshaft, said cam formed on said outer annular surface and said valve elements reciprocable along a longitudinal axis perpendicular to the rotational axis of said camshaft.

9. The high pressure fuel injection system of claim 1, wherein said pump means maintains fuel in said accumulator means for distribution to the engine cylinders at a predetermined pressure above 15,000 psi.

10. A fuel distributor for a high pressure fuel injection system capable of distributing fuel at a predetermined pressure through plural fuel injection lines to the corresponding cylinders of a multi-cylinder internal combustion engine, comprising:

a distributor housing including a supply inlet passage and a plurality of fuel injection outlet passages for delivering high pressure fuel from said supply inlet passage to the plural injection lines;

a distribution means mounted in said distributor housing for enabling sequential periodic fluidic communication between said supply inlet passage and said plurality of fuel injection outlet passages, said distribution means including a plurality of distributor valves, each of said plurality of distributor valves being positioned in fluidic communication with a respective one of said plurality of fuel injection outlet passages and adapted to be placed in an open position to define a fuel injection period during which high pressure fuel may flow through said distributor valve to the respective engine cylinder and a closed position blocking fuel flow through said respective fuel injection outlet passage, wherein each of said plurality of distributor valves is adapted to receive a force from the high pressure fuel flowing from said supply inlet passage which urges said distributor valve into the closed position.

11. The high pressure fuel injection system of claim 10, wherein said distributor housing includes a plurality valve seats, each one said valve seats positioned adjacent a respective one of said distributor valves, each of said distributor valves being of the poppet-type having a valve element mounted for reciprocal movement in said distributor housing for engaging a respective one of said valve seats when said poppet-type distributor valve is in the closed position.

12. The high pressure fuel injection system of claim 11, wherein said poppet-type distributor valves are moved from the closed to the open position by a solenoid actuator.

13. The high pressure fuel injection system of claim 11, further including a camshaft rotationally mounted in said distributor housing, said camshaft including a cam for causing said valve elements of said poppet-type distributor valves to reciprocate as said camshaft is rotated.

14. The high pressure fuel injection system of claim 13, wherein said camshaft includes an end face positioned perpendicular to a rotational axis of said camshaft, said cam formed on said end face and said valve elements reciprocable along a longitudinal axis parallel to the rotational axis of said camshaft.

15. The high pressure fuel injection system of claim 13, wherein said camshaft includes an inner annular surface extending annularly around a rotational axis of said camshaft, said cam formed on said inner annular surface and said valve elements positioned between said inner annular surface and said camshaft and reciprocable along a longitudinal axis perpendicular to the rotational axis of said camshaft.

16. The high pressure fuel injection system of claim 13, wherein said camshaft includes an outer annular surface extending around a rotational axis of said camshaft, said cam formed on said outer annular surface and said valve elements reciprocable along a longitudinal axis perpendicular to the rotational axis of said camshaft.

17. The high pressure fuel injection system of claim 11, wherein each of said plurality of distributor valves includes a bias spring for biasing said valve element into engagement with said valve seat, and further including a delivery valve positioned in each of said plurality of fuel injection passages for preventing the flow of fuel from said injection lines to said plurality of distributor valves, said distributor housing including a plurality of valve cavities extending radially from said camshaft and equally spaced around the circumference of said camshaft for receiving a respective valve element and a respective bias spring.

* * * * *